United States Patent [19]

Osawa et al.

[11] Patent Number: 4,730,553

[45] Date of Patent: Mar. 15, 1988

[54] METHOD OF OPERATING AN AIR-SUPPLIED TYPE COATING BOOTH

[75] Inventors: Michiaki Osawa, Nagoya; Hidetoshi Omori, Toyota; Hidemasa Inoue; Yoshihiro Shibata, both of Seto; Hideyuki Takata, Nagoya; Yasuo Tokushima, Toyota; Shunichi Akiyama, Toyota; Masayuki Kojima, Toyota; Zyouzi Itou, Toyota, all of Japan

[73] Assignees: Trinity Industrial Corporation, Tokyo; Toyota Jidosha Kabushiki Kaisha, Toyota, both of Japan

[21] Appl. No.: 947,386

[22] Filed: Dec. 29, 1986

[30] Foreign Application Priority Data

Dec. 27, 1985 [JP] Japan ..... 60-293217
Dec. 27, 1985 [JP] Japan ..... 60-293218

[51] Int. Cl.[4] ..... B05B 15/12
[52] U.S. Cl. ..... 98/115.2; 98/36
[58] Field of Search ..... 98/36, 115.1, 115.2, 98/115.3; 118/326

[56] References Cited

U.S. PATENT DOCUMENTS 4,261,256 4/1981 Joret ..... 98/115.2
4,653,387 3/1987 Ojawa et al. ..... 98/115.2

FOREIGN PATENT DOCUMENTS 26359 4/1981 European Pat. Off. ..... 98/115.2

*Primary Examiner*—Harold Joyce
*Attorney, Agent, or Firm*—Cushman, Darby & Cushman

[57] ABSTRACT

A method of operating an air-supplied type coating booth in which conditioned air supplied from an air supply blower is enforced downwardly to the inside of a tunnel-shaped coating booth and the air in the coating booth is drawn together with paint mists and the likes down to the beneath of a booth floor by way of an air exhaust blower comprises the steps of detecting the flow velocity of air streams flowing into or out of inlet and the exit of the coating booth, applying primary and secondary averaging processings for signals for averaging variations caused by external disturbances fluctuating at relatively shorter and longer periods of time, judging the thus averaged direction and the flow velocity of the air streams at the inlet and the exit, variably controlling the flow rate of exhaust from the exhaust blower in accordance with the direction and the flow velocity. The exhaust blower means are divided into a plurality of blowers and the minute variations in the direction and the flow velocity are controlled excessively by the blowers situated at the inlet and the exit of the coating booth, while remaining exhaust blowers are operated at predetermined flow rate.

11 Claims, 6 Drawing Figures

METHOD OF OPERATING AN AIR-SUPPLIED TYPE COATING BOOTH

BACKGROUND OF THE INVENTION

1. Field of the Invention

This invention concerns a method of operating an air-supplied type coating booth in which conditioned air supplied from an air supply blower to a plenum chamber is enforced through a filter at a predetermined flow velocity downwardly to the inside of a tunnel-shaped coating booth and the air in the coating booth is drawn to discharge together with paint mists, evaporated organic solvents and the likes to the beneath of a booth floor by way of an exhaust blower.

2. Description of the Prior Art

In a relatively large-scaled air-supplied type coating booth used, e.g., for coating car bodies conveyed successively on a conveyor, conditioned air supplied from an air supply blower to a plenum chamber is enforced to the inside of a tunnel-shaped coating booth disposed between a pretreatment device for coating and a drying furnace for coated articles. The air thus enforced downwardly to the coating booth is drawn to discharge to the beneath of the booth floor together with paint mists, evaporated organic solvents and the likes by means of an exhaust blower, so that the paint mists, dusts or the likes which would otherwise give undesired effects on the coated films may be prevented from scattering and drifting upwardly, thereby maintaining favorable coating quality, as well as keeping the health of operators who make preparatory work for the coating or conduct manual spray coating within the coating booth.

By the way, in the coating booth of the type as described above, if the flow rate of air supplied from the air supply blower and that of exhaust air discharged by the exhaust blower are different, external air containing dusts or the likes would intrude to the inside of the coating booth through the inlet and the exit opened at both ends thereof to degrade the quality of coated films applied on the car bodies, or air contaminated with paint mists, evaporated organic solvents and the likes in the coating booth would flow out of the coating booth through the inlet and the exit to contaminate the circumstantial peripheries such as a pre-treatment device for coating or a drying furnace for coated articles. Accordingly, the air supply blower and the exhaust blower have usually been driven at a predetermined constant number of rotation or constant angle of blade, so that the flow rate of the conditioned air supplied from the supply blower and the flow rate of the exhaust air drawn to discharge by the exhaust blower to the beneath of the floor of the coating booth are balanced with each other.

However, since a plurality of slits are formed as air sucking ports to the floor of the air-supplied type coating booth adapted to draw the air in the coating booth to the beneath of the floor and car bodies are successively conveyed passing over the slits, the sucking ports are closed with the car bodies. Accordingly, the flow rate of the exhaust air is decreased, in other words, flow rate of the air supplies is increased relatively thereby causing the contaminated air in the coating booth to flow outwardly through the inlet and the exit depending on the case.

Thus, in the case where the number of rotation or the angle of blade of the air supply blower and the exhaust blower is previously set constant as in the prior art, the balance between the flow rates of the supplied air and the exhaust air is lost in accordance with the increase or decrease in the quantity of coated articles such as car bodies conveyed through the coating booth, and air may possibly flow into and out of the coating booth through the inlet and exit thereof.

In view of the above, the present inventors et al. have already proposed a method of operating an air-supplied type coating booth, which comprises detecting the flow velocity of air flowing into or out of the coating booth through the inlet and the exit thereof, variably controlling the flow rate of the exhaust air discharged from an exhaust blower in accordance with the flow rate of air stream flowing into and out of the booth calculated based on the flow velocity thereby keeping a balance between the flow rate of the exhaust air discharged from the exhaust blower and the flow rate of the air supplied from the supply blower thus preventing the air stream from flowing into and out of the coating booth through the inlet and the exit thereof (U.S. patent application Ser. No. 789,769 filed on Oct. 21, 1985 and now allowed, entitle as "Method of operating an air feed type spray booth").

In the operation method of our proposed prior patent application, if the balance between the flow rate of the supplied air and the flow rate of the exhaust air is lost due to the increase or decrease in the number of coated articles to be conveyed and air stream tend to flow into and out of the coating booth through the inlet and the exit thereof, the flow rate of the exhaust blower is controlled to increase or decrease depending on the detected flow velocity to prevent the air stream from flowing into and out of the booth through the inlet and the exit.

However, it has been found by our subsequent studies and experiments that fluctuations, disturbances or, depending on the case, even swirlings are resulted in the air streams at the inlet and the exit of the coating booth under the effect of external atmosphere or the coated objects to be conveyed into and out of the booth and they cause irregular variations in the detected flow velocity.

That is, it has been found that when the flow velocity at the inlet and the exit is continously measured by flow velocity sensors, measured signals inevitably contain primary variations fluctuating at relatively shorter periods, for example, about from 1 to 4 seconds caused, for example, by disturbances in the air streams upon contact with the flow velocity sensors or the characteristics of the sensors per se and secondary variations fluctuating at relatively longer periods caused, for example, by disturbances in the air streams when the coated objects are conveyed into and out of the booth. The measured signals are also varied abruptly when a sudden wind flows into and out of the coating booth briefly through the inlet and the exit thereof.

In addition, when the flow velocity of the air streams flowing out of the booth is detected, for example, as a positive signal while the flow velocity of the air streams flowing into the booth is detected as a negative signal, the foregoing disturbances in the air streams or the likes may some time cause not only the variation in the absolute value but also the change for the polarity (direction) of the air streams, by which a detection signal varying, for example, on the positive level may be changed suddenly into the negative level.

In this case, if the flow rate of the exhaust air discharged from the exhaust blower is intended to control accurately following after every minute and frequent variations, fine and frequent adjustment is required for controlling the operation of the exhaust blower. However, it is troublesome and difficult for the blower which usually has a considerable inertia, and the desirable balance between the flow rates of air supply and exhaust may rather be lost depending on the case. Thus, the air stream flowing into or out of the coating booth through the inlet and the exit thereof may some time be promoted rather than hindered.

For preventing the air flow from flowing into or out of the coating booth through the inlet and the exit thereof by the control for the operation of the exhaust blower, there occurs another problem.

That is, if the exhaust blower is controlled for the minute or fine disturbances resulted at the inlet and the exit of the booth that are caused only instantaneously by external disturbances having no substantial concerns with the balance between the flow rate of the supply blower and that of the exhaust blower, over-control will often be resulted to the exhaust blower making the operation instable and rather causing unfavorable effects on the balance in the coating booth.

Thus, although the exhaust blower is usually controlled for suppressing the air streams to flow out or into the coating booth through the inlet and the exit, it is desirable that the operation of the blower be kept steadly as much as possible unless it is required, so as not to disturb the balanced state once attained between the flow rate of the air supply blower and the exhaust blower.

OBJECT OF THE INVENTION

Accordingly, it is an object of this invention to provide a method of operating an air-supplied type coating booth capable of properly and exactly detecting the averaged state of air streams flowing into or out of the inlet and the exit of the coating booth, controlling the flow rate from an exhaust blower variably and reliably while preventing the air streams from flowing into and out of the coating booth through the inlet and the exit thereof, while ignoring sudden and minute variations caused from external disturbances but not from the substantial imbalance between the flow rate of air supplied from the supply blower and the flow rate of exhaust air discharged from the exhaust blower.

Another object of this invention is to provide a method of operating an air-supplied type coating booth capable of effectively suppressing the air streams not to flow out or into the coating booth at the inlet and the exit thereof while keeping the operation control of the exhaust blower as less as possible.

SUMMARY OF THE INVENTION

The first object of this invention can be attained by the first method of operating an air-supplied type coating booth, in which conditioned air supplied from an air supply blower to a plenum chamber is enforced downwardly to the inside of a tunnel-shaped coating booth and the air thus enforced in the coating booth is drawn to discharge by an exhaust blower together with paint mists, evaporated organic solvents and the likes to the beneath of the floor, wherein the method comprises:

a step of detecting the flow velocity of air streams flowing into and out of the inlet and the exit opened at both ends of the coating booth by flow velocity sensors;

a step of applying primary averaging processing to signals for detected flow velocity by sampling the signals at a relatively shorter sampling period for the variations that are contained therein caused by the characteristics of the sensors or the likes and fluctuate at relatively higher cycles;

a step of applying secondary averaging processing to the signals after the primary averaging processing by sampling the signals at a relatively longer sampling period for the variations that are contained therein caused by the passage of coated objects at the inlet and the exit of the coating booth and the like and fluctuate at relatively lower cycles;

a step of judging the direction of the air flow and determining the flow velocity thereof at the inlet and the exit; and a step of variably controlling the flow rate of the exhaust air discharged from the exhaust blower in accordance with the direction and the flow velocity of the air thereby suppressing the air flowing into or out of the coating booth through the inlet and the exit thereof.

According to the first method of this invention, if the signals for detected flow velocity of air steams at the inlet and the exit of the coating booth contain variations that fluctuate at relatively shorter periods, for example about from 1 to 4 seconds caused by external disturbances such as characteristics of the sensors per se variations that fluctuate at relatively longer period, for example, about from 10 to 30 seconds caused by car bodies or like other coated objects to be conveyed into and out of the coating booth, as well as abrupt variations due to sudden winds or the likes, the effects of the former variations are at first eliminated by applying the primary averaging processing by sampling at a relatively shorter sampling period followed by averaging and then the effect of the latter variations are eliminated by further applying the secondary averaging processing to the thus averaged signals by sampling them at a relatively longer sampling period followed by averaging.

Therefore, the direction of the air streams can reliably be judged and, at the same time, the flow velocity thereof can also be measured exactly at the inlet and the exit of the coating booth with no erroneous effects from the various external disturbances. Then, the exhaust blower is variably controlled by the thus averaged signals while ignoring the undesired effects due to external disturbances, by which air streams can be prevented reliably from flowing into and out of the coating booth through the inlet and the exit thereof.

Another object of this invention can be attained by the second method of operating an air-supplied type coating booth, in which conditioned air supplied from an air supply blower to a plenum chamber is enforced downwardly to the inside of a tunnel-shaped coating booth and the air thus enforced in the coating booth is drawn to discharge by exhaust blower means together with paint mists, evaporated organic solvents and the likes to the beneath of the floor.

wherein a plurality of exhaust blowers are disposed each corresponded to each of divisional zones defined along the longitudinal direction of the coating booth and wherein the method comprises:

a step of detecting the flow velocity and the flow direction of air streams flowing into and out of the inlet and the exit opened at both ends of the coating booth, and a step of determining the direction and the flow velocity of the air streams at the inlet and the exit, and a step of variably controlling the flow rate of exhaust air discharged from a portion of a plurality of exhaust blowers in accordance with the flow direction and the flow velocity of the air streams at the inlet and the exit of the coating booth.

According to the second method of this invention, since only a portion of a plurality of exhaust blowers is controlled for the change in the flow direction and the flow velocity of the air streams, fine and rapid control is possible as compared with the case where the single and large capacity blower is controlled, with no over-control and no undesired effect on the entire balance between the flow rate of air supplied from the supply blower and that discharged from the exhaust blower.

Particularly, in a preferred embodiment in which the control is effected only to the exhaust blowers disposed at the inlet and the exit of the coating booth, more effective and direct control is possible.

BRIEF DESCRIPTION OF THE ACCOMPANYING DRAWINGS

These and other objects, as well as the features of this invention will become apparent by reading the descriptions for preferred embodiments thereof referring to the accompanying drawings, wherein FIG. 1 is a schematic view illustrating one embodiment of an air-supplied type coating booth using the first method according to this invention;

DESCRIPTION OF THE PREFERRED EMBODIMENTS

Figure 1:
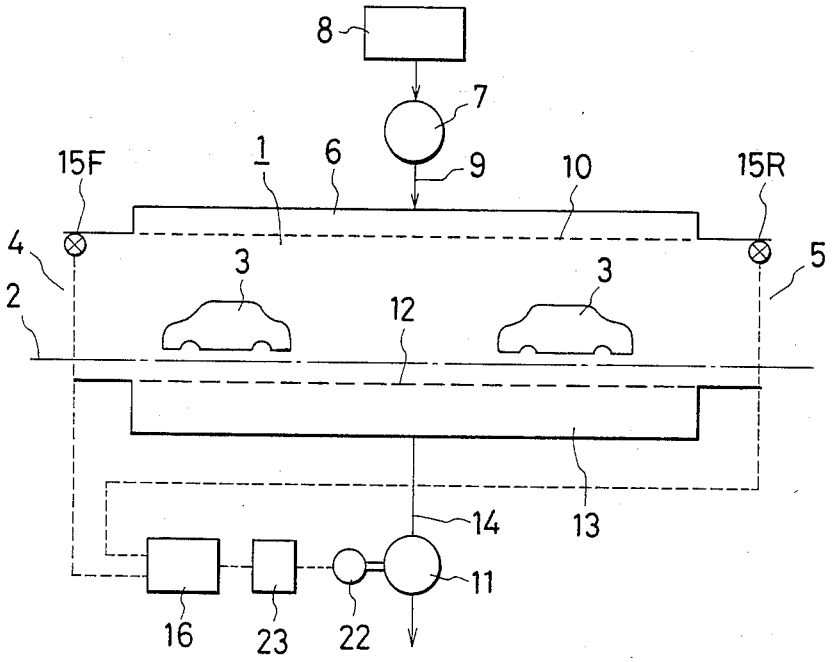

This invention will now be described more in details while referring to the embodiments shown in the drawings.

EXAMPLE 1

Figure 2:
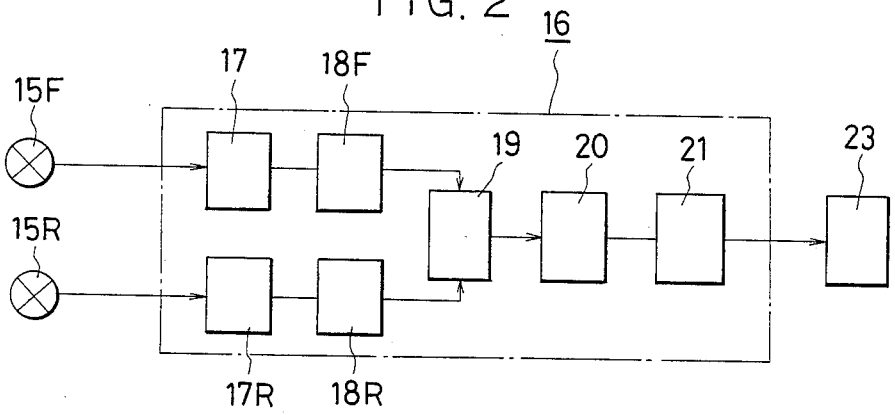
FIG. 2 is a block diagram illustrating an embodiment of the control device used therefor.

FIG. 1 is a schematic view illustrating one embodiment of an air-supplied type coating booth using the first method according to this invention and FIG. 2 is a block diagram illustrating one embodiment of a control device used therefor.

In the drawing, a coating booth 1 has a tunnel-like configuration for conducting spray coating to car bodies 3, 3,—conveyed successively on a floor conveyor 2 or the like, and inlet 4 and exit 5 opened at booth ends thereof are in communication with a pre-treatment device for coating car bodies at the preceeding stage and a drying furnace for coated car bodies at the succeeding stage (both not illustrated) of the coating booth 1 respectively.

The coating booth 1 has a plenum chamber 6 disposed along the ceiling thereof, and the conditioner plied by a supply blower 7 from an air-conditioning device 8 and a supply duct 9 to the inside of the plenum chamber 6 is enforced through filters 10 to the inside of the coating booth 1.

The conditioned air enforced to the inside of the coating booth 1 is caused to flow downwardly in the booth 1 at a uniform velocity, for example, of about 0.2 to 0.5 m/sec, drawn together with paint mists, evaporated organic solvents and the likes by exhaust blower 11 to the beneath of floor 12 into mist processing chamber 13, where it is separated from the paint mists through gas-liquid contact and then exhausted externally through exhaust duct 14.

Sensors 15F and 15R are disposed at the inlet 4 and the exit 5 of the coating booth 1 respectively for detecting the flow velocity and the direction of air streams flowing into or out of the booth 1 through the inlet 4 and the exit 5.

In this embodiment, the flow velocity for the air streams flowing out of the booth is outputted as a signal at a positive level, while the flow velocity for the air stream flowing into the booth is outputted as a signal at a negative level to control device 16 respectively.

The control device 16 comprises samplers 17F and 17R for sampling the detection signals outputted from the sensors 15F and 15R at a predetermined sampling period (for instance, 0.2 sec), digital filters 18F and 18R working on a transmission function with a first order lag, weighted averaging section 19 for conducting weighted averaging processing for the signal at the inlet 4 and the signal at the exit 5 outputted from the digital filters 18F and 18R, a moving averaging section 20 for sampling the output signal from the weighted averaging section 19 at a predetermined sampling period (for instance, 6 sec), applying the moving averaging processing and determining the flow velocity at that time, and adjuster 21 for performing a predetermined PID calculation based on the output from the moving averaging section 20, in which an actuation signal is outputted from the adjuster 21 to inverter 23 for controlling the motor 22 for the exhaust blower 11 to increase or decrease the exhaust flow rate therefrom.

Figure 3:
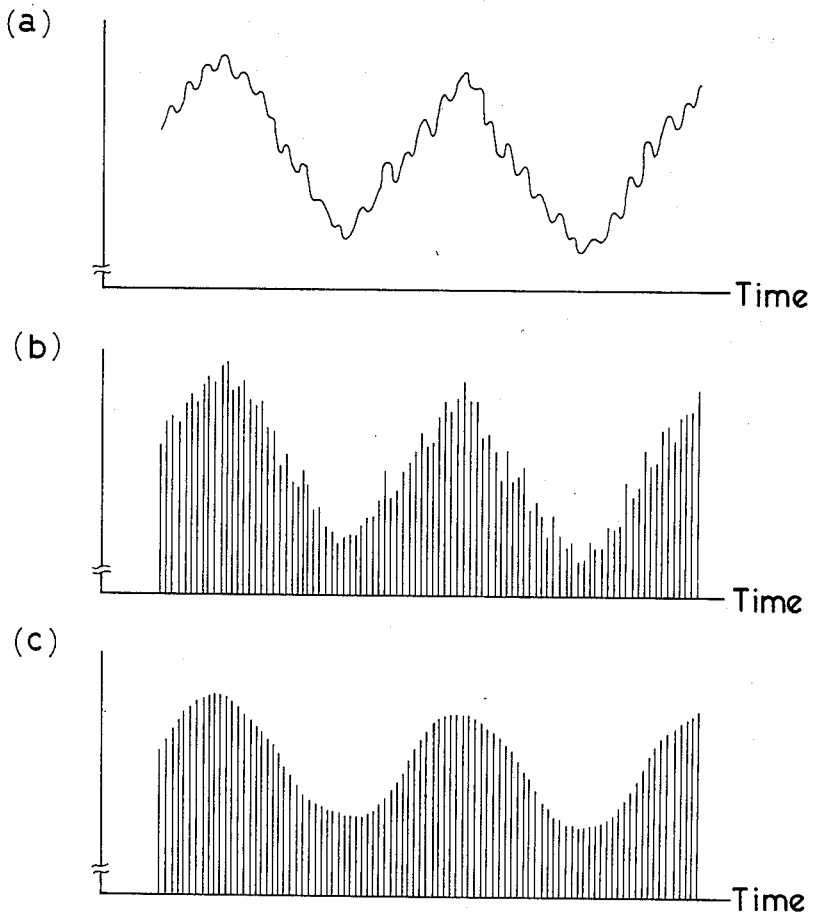
FIGS. 3 and 4 are, respectively, explanatory views illustrating examples of signal wave forms at each of the points in the control device.
Figure 4:
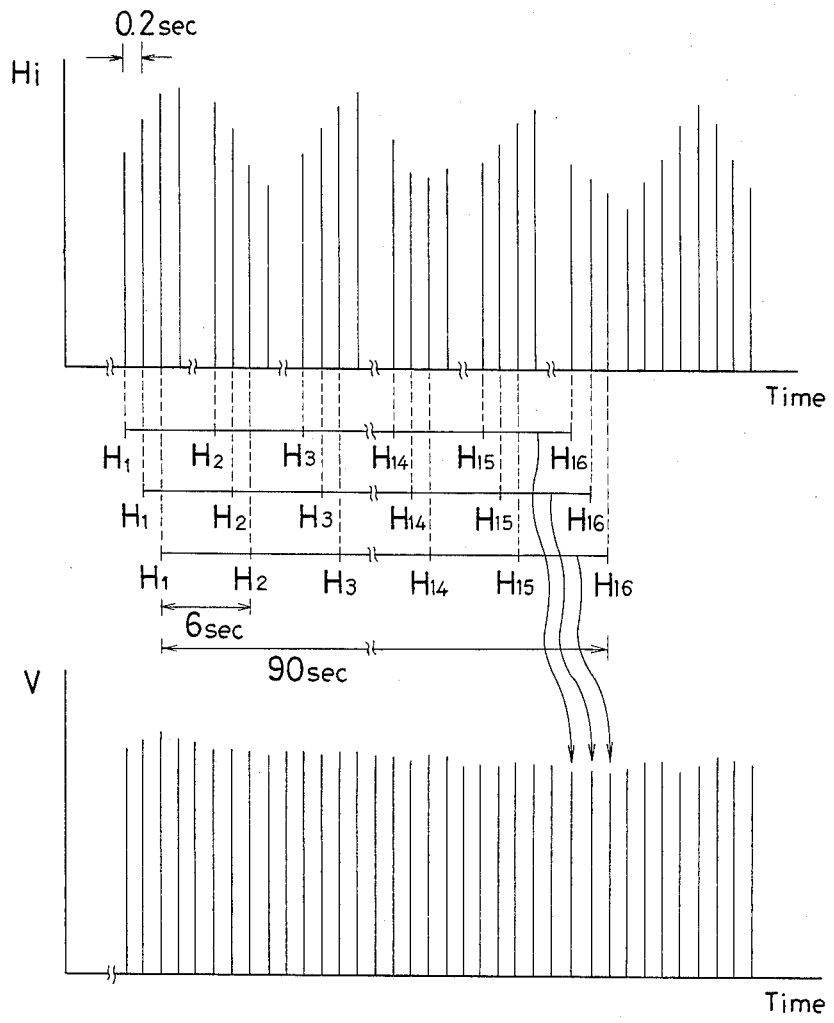

FIGS. 3 and 4 are explanately views illustrating the examples of signal waveforms at each of the points in the control device 16.

In the case as shown in FIG. 3(*a*), where the detection signal outputted from the sensor 15F (or 15R) contains, primary variations caused by external disturbances fluctuating at relatively higher cycle, for example, of about 20 cycle/min and secondary variations caused by external disturbances fluctuating at relatively lower cycle, for example, of about 4 cycle/min, the signals for detected flow velocity are at first sampled at a relatively shorter sampling period of about 0.2 sec by the sampler 17F (or 17R) into digital signals represented by the pulse train as shown in FIG. 3(*b*).

Then, when the digital signals are inputted to the digital filter 18F (or 18R), since the digital filter 18F (or 18R) works on a transmission function with first order delay $1/(1+Ts)$, smoothed signals in which the primary vibrations at about 20 cycle/min are eliminated and the amplitude is somewhat decreased are obtained at the output as shown in FIG. 3(*c*).

Then, two signals outputted respectively from the digital filters 18F and 18R are applied with weighted averaging processing in the weighted averaging section 19 into synthesized signals and then inputted to the moving averaging section 20 for the moving averaging processing.

The moving averaging processing means a method of sampling n shots of input signals at a period: $C=T/(n-1)$ within a predetermined moving averaging time T and determining the flow velocity at that time as the mean value for the values of n shots of input signals, which is carried out for eliminating the effects where the air streams are fluctuated or disturbed slowly in the coating booth 1.

Assuming the moving averaging time T as 90 sec. and the sampling period C in the moving averaging section as 6 sec, the number of sampled signals is represented as: $n=90/6+1=16$, and the flow velocity can be determined as the mean value for the values of 16 input signals sampled at 6 sec of period as shown in FIG. 4.

That is, the flow velocity V calculated based on the sampled input signals H1 in the moving averaging section 20 is represented as:

$$V = \sum_{i=1}^{16} Hi/16$$

Since the signals are inputted at 0.2 sec of period to the moving averaging section 20, moving averaging processing is conducted on every new inputs and the values are outputted (refer to FIG. 4).

When carrying out such a moving averaging processing, it is possible to determine the mean value for the moving averaging time (for instance, 90 sec), which is sufficiently longer than the sampling period (6 sec) in the moving averaging section 20. Accordingly, in the output signals from the moving averaging section 20, variations if any, in the air streams caused by the external disturbances fluctuating at about 4 cycle/min and can not be eliminated by the digital filters 18F, 18R can now be averaged, by which undesirable and unnecessary descrease or increase in the exhaust flow rate resulted from the effect of the variations can be suppressed (refer to the lower part in FIG. 4).

Then, the signals eliminated with the primary variations and secondary variations due to external disturbances by the digital filteres 18F and 18R and by the moving averaging section 20 are inputted into the controller 21 for the PID calculation.

The PID calculation in this embodiment means such a mathematical operation for generating an actuation signal based on the input for the deviation between a measured value and an aimed value by using 3-operation adjuster for the proportional calculation P, integrating calculation I and differentiation calculation D. Since the control in this invention may be conducted such that the flow velocity V at the inlet 4 and the exit 5 of the coating booth 1 is reduced to 0, the aimed value is 0 and, accordingly, the detected flow velocity is used as it is for the deviation.

Further, since no differentiation is generally required for the flow rate control, the output M from the controller 21 in the PID calculation for the digital signals is determined as:

$$M = MI + dM$$

$$= MI + K(E - EI + (t/Ti)E)$$

where

MI: output at the preceeding detection,
E: present input (deviation)
EI: input at the preceeding detection
K: proportional gain
t: period for the input signal
Ti: integration time Then, the thus determined output M is outputted as an actuation signal to the inverter 3 that increases or decreases the number of rotation of the exhaust blower 11 to variably control the exhaust flow rate. For instance, in a case where the air streams are flowing out and the flow velocity value is gradually increased, since $E<0$ and $E-E1<0$, dM is always greater than 0 and the actuation signal is increased as compared with that in the proceeding detection to increase the exhaust flow rate. On the contrary, if the air streams are flowing into the booth, since $E<0$ and $E-E1<0$, dM is always smaller than 0 and the actuation signal is smaller as compared with that in the former output to decrease the exhaust flow rate.

An example for the constitution of the air-supplied type coating booth using the first method according to this invention has thus been described and the method of operation will now be explained.

The operation of the coating booth 1 is started by at first actuating the motor 22 for the exhaust blower 11 and the motor 24 for the supply blower 7 while setting predetermined number of rotations therefor, supplying conditioned air from the supply blower 7 to the inside of the coating booth 1 having, for example, 6 m width at a flow rate of about 7200 $m^3$/min per 50 m booth length, and discharging the thus enforced air at the same flow rate as above to the outside of the coating booth 1 by the exhaust blower 11. Then, the flow velocities for the air streams at the inlet 4 and the exit 5 are detected by the sensors 15F and 15R.

When the car bodies 3, 3,—are successively conveyed on the floor conveyor 2 to the inside of the coating booth 1 and the sucking ports of the floor surface 12, from which the air in the coating booth 1 is drawn, are closed with these car bodies, the power load on the exhaust blower 11 is increased and, accordingly, the exhaust flow rate is relatively decreased. Then, the air in the coating booth 1 is caused to flow outwardly through the inlet 4 and the exit 5.

In this case, detection signals at a positive level are outputted from the sensors 15F and 15R disposed at the inlet 4 and the exit 5 to the control device 16. The signals are sampled at 0.2 sec of period by the samplers 17F and 17R, applied with the averaging processing in the digital filters 18F and 18R in the weighted averaging section 19 and in the moving averaging section 20. Thus, the flow velocity on every 0.2 sec point is determined and then the flow velocity is inputted into the controller 21 for a predetermined PID calculation and an actuation signal is outputted from the controller 21 to the inverter 23 to increase the number of rotation of the motor 22 for the exhaust blower 11.

Then, when the number of rotation for the motor 22 the drives the exhaust blower 11 is increased, the flow rate of the exhaust air from the coating booth 1 by way of the exhaust duct 14 is increased to be equal with the flow rate of the air supplied from the supply blower 7, whereby the coating booth 1 is maintained in a state where there is no substantial exchange of air with external atmosphere through the inlet 4 and the exit 5.

On the contrary, if the number of the car bodies 3 conveyed in this state is decreased, since the area sucking ports of the floor surfaces 12 closed with the car bodies 3 is reduced to decrease the power load on the exhaust blower 11, the flow rate of the exhaust air is relatively increased in this case causing external air to flow into the coating booth 1 through the inlet 4 and the exit 5 thereof.

In this case, negative detection signals are outputted from the sensors 15F and 15R and the signals are hereinafter processed in the similar manner as described above and an actuation signal is outputted to the inverter 23 such that the number of rotation for the motor 22 is decreased.

Then, as the number of rotation for the motor 22 is decreased, the flow rate of the exhaust air discharged from the inside of the coating booth 1 by way of the exhaust duct 14 is decreased to be equal with the flow rate of the air supplied, whereby the external air can be prevented from flowing into the booth through the inlet and the exit.

Although the descriptions have been made to the embodiment, in which the PID adjuster 21 is used as the means for determining the actuation signal, this invention is no way limited only to such an embodiment but it may be embodied such that the flow rate of the air streams flowing into and out of the inlet 4 and the exit 5 is calculated based on the determined flow velocity and the flow rate of the exhaust air from the exhaust blower 11 is variably controlled depending on the flow rate of the air streams.

Further, means for variably controlling the flow rate of the exhaust air is not necessarily limited to the variable control for the number of rotation of the motor 22 for the exhaust blower 11, but the angle of blade of the blower may be controlled in a case where a blower with variable blade angle is used, or the opening angle of a damper separately disposed to the inside of the exhaust duct 14 may be controlled.

Furthermore, although the descriptions have been made to the embodiment, in which the sensors 15F and 15R are disposed at the inlet 4 and the exit 5 respectively of the coating booth 1, the sensor may be disposed to either one of the inlet 4 or the exit 5 in this invention.

EXAMPLE 2

Figure 5:
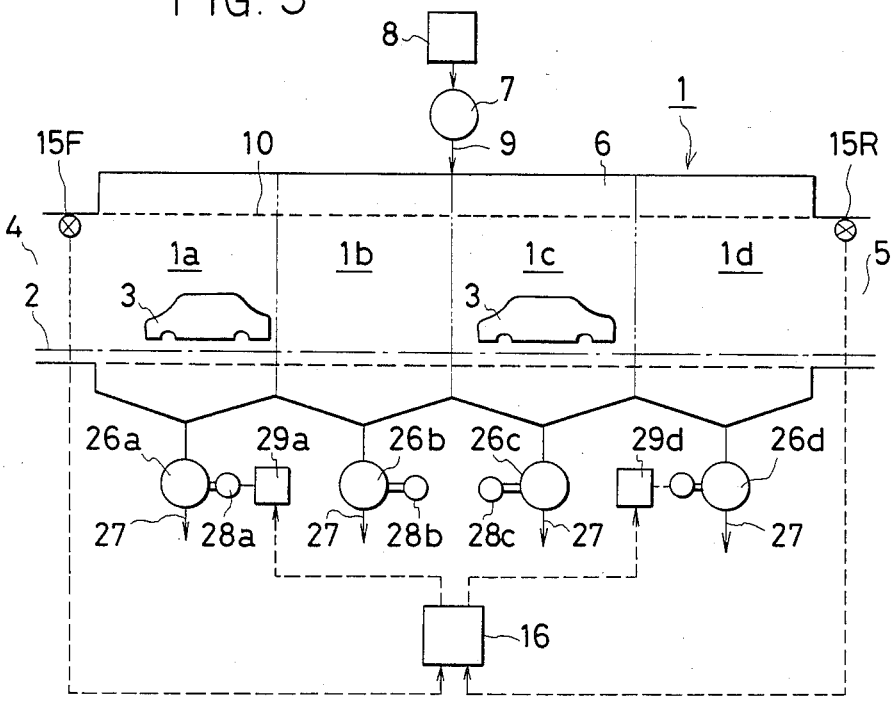
FIG. 5 is a schematic view illustrating another embodiment of the air-supplied type coating booth using the second method according to this invention.
Figure 6:
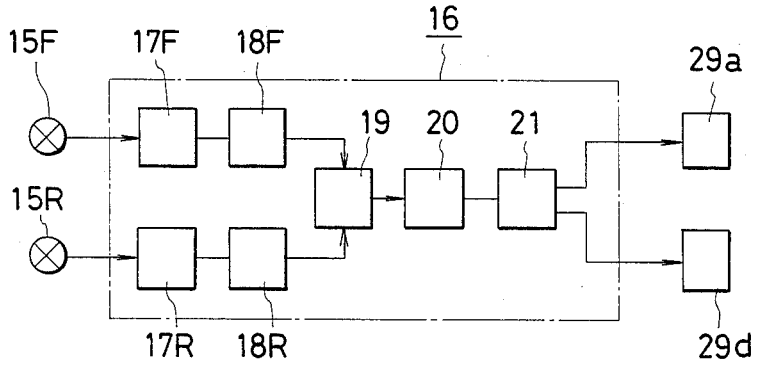
FIG. 6 is a block diagram illustrating one embodiment of the control device used therefor.

FIG. 5 shows a schematic view for the coating booth as another embodiment using the second method according to this invention and FIG. 6 is a block diagram illustrating one embodiment of the control device used therefor.

Same components and sections as those in FIGS. 1 and 2 carry the same reference numerals and detailed descriptions therefor are omitted.

This embodiment is suitable to a case where the path of the coating booth is much longer and the control is intended for the exhaust amount corresponding to relatively minute changes in the flow rate of air flowing into and out of the coating booth 1 through the inlet 4 and the exit 5 while disturbing the balanced state already established in the entire inside of the coating booth as less as possible. If only one exhaust blower is used for drawing to exhaust the air for the entire region within the coating booth 1, the capacity of the exhaust blower has to be extremely large. Since the minimum step for fine control of the exhaust flow rate of an ordinary exhaust blower is about 1% of the rated capacity, adjustable minimum variation range is increased as the blower capacity is increased. Accordingly, if the flow rate of air streams flowing into or out of the coating booth 1 through the inlet 4 and the exit 5 is minute, it can not be exactly compensated by a large capacity blower. Then, over-control occurs occassionally. That is, the flow velocity at the inlet 4 and the exit 5 may some time be changed excessively by the control of the exhaust blower, failing to obtain exact control and to effectively suppress the air streams from flowing into and out of the coating booth. In addition, if minute changes in the air stream caused by instantaneous external disturbances having no concerns with the imbalance between the flow rates of the supply and exhaust blowers are controlled to eliminate, exhaust blower control possibly breaks the balance kept suitable so far may be lost undesirably.

In this second embodiment, the coating booth 1 is deviced from the side of the inlet 4, for example, into a preparately zone **1*a*, automatic coating zone 1*b*, setting zone 1*c*, manual spray coating zone 1*d* and the like. Mist processing chambers 25*a*, 25*b*, 25*c* and 25*d* are disposed below the floor surface 12 corresponding to the zones 1*a*–1*d* respectively and the mist processing chambers 25*a*–25*d* are connected with exhaust ducts 27, 27,—by way of exhaust blower 26*a*, 26*b*, 26*c* and 26*d* respectively, so that air in each of the zones 1*a*–1*d* in the coating booth 1 is drawn to the beneath of the floor surface 12, separated from the paint mists through gas-liquid contact in each of the mist processing chambers 25*a*–25*d*, and then exhausted externally through each of the exhaust ducts 14**.

The total exhaust capacity for the exhaust blowers **26*a*–26*d* is selected such that it is equal with the capacity of the supply blower 7 for supplying air, that is, each of the capacity for the exhaust blowers 26*a*–26*d* is selected, for example, to about 2500 $m^3$/min in the case where the supply blower 7** has the capacity of about 10,000 $m^3$/min.

In this embodiment, motors **28*b* and 28*c* for driving the exhaust blowers 26*b* and 26*c* connected to the mist processing chambers 25*b* and 26*c* disposed at the middle portion of the coating booth 1 are usually set to predetermined numbers of rotation which are set upon starting the booth operation, so that the exhaust blowers 26*b* and 26*c* are always operated at a constant number of rotation, except when the entire balance between the flow rates of the supplied air and the exhaust air is lost due to clogging in the filter or the like. While on the other hand, the number of rotation are variably controlled only for the motors 28*a* and 28*d* that drive the exhaust blowers 26*a* and 26*d* disposed at the inlet 4 and the exit 5 of the coating booth 1** depending on the flow velocity of air streams.

That is, signals for the detected flow velocity outputted from the sensors 15F and 15R are inputted into the control device 16 in the similar manner as in the previous embodiment, in which they are sampled at a predetermined sampling period in the samplers 17F and 17R. The thus sampled signals are applied with the primary averaging processing in the digital filters 18F and 18R, the signals outputted from each of the digital filters 18F and 18R are synthesized in the weighted averaging section 19 and applied with the second averaging processing in the moving averaging section 20. Then, PID calculation is applied by the adjuster 21 and the flow velocity at that time is determined.

Then, the actuation signal outputted from the adjuster ler 21 is inputted to the respective inverters **29*a* and 29*d* for controlling the number of rotation of the motors 28*a* and 29*d* of the exhaust blowers 26*a* and 26*d* to increase or decrease the flow rate of the exhaust air discharged from the exhaust blowers 26*a* and 26*d* by which the flow of contaminated air through the inlet 4 and the exit 5 to the outside and the flow of external air through the inlet 4 and the exit 5** into the coating booth can surely be prevented.

In this case, since each of the capacity for the exhaust blowers 26*a* and 26*d* is reduced to about $\frac{1}{4}$ as compared with the case where only one large exhaust blower is used, the total capacity for the two exhaust blowers 26*a* and 26*d* is reduced to about $\frac{1}{2}$ of the latter. Accordingly, assuming the adjustable minimum range for the exhaust flow rate, for example, as 1% of the rated capacity, finer control can be conducted even for 0.5% of adjustable range for the entire exhaust flow rate, whereby the flow of the air stream into and out of the coating booth 1 through the inlet 4 and the exit 5 can surely be suppressed by changing the exhaust flow rate only for the blowers 26*a* and 26*b* following after the extremely low flow rate of air streams flowing into and out of the inlet 4 and the exit 5.

If the minute variations in the flow velocity or the instantaneous change in the flow direction of the air streams at the inlet and the exit of the booth 1 is intended to be controlled by only one large-capacity blower as in the previous embodiment, it will some time cause overcontrol or break the entire balance between the flow rates of air supplied and discharged by the blowers because of the large inertia of the exhaust blower, etc.

In view of the above in this second embodiment, control for the minute and instantaneous variations of the air streams at the inlet 4 and the exit 5 of the coating booth 1 are exclusively treated only by the smaller capacity blowers 26*a* and 26*d*. While on the other hand, the control for the recovery from the imbalance between the flow rate of the supplied air and the flow rate of the exhaust air caused gradually, for example, by the clogging in the filter 10 with the elapse of time is carried out periodically or occasionally by all of the blowers 26*a*–26*d* including the blowers 26*b* and 26*c* which are usually operated at a constant number of rotation or angle of blade.

Accordingly, in this embodiment in which the capacity of the exhaust blower means is divided so as to share the control for the variations in the air streams at the inlet and the exit and for the balance between the flow rate of the supplied air and that of the exhausted air, it is possible to suppress fine and instantaneous variations in the air streams at the inlet and the exit without disturbing the balance kept between the air supply flow rate and exhaust flow rate.

Although the explanations have been made to this embodiment in which the detection signals from the sensors 15F and 15R are synthesized in the weighted averaging section 19 and the numbers of rotation for the exhaust blowers 26*a* and 26*d* are controlled, this invention is no way limited only to such an embodiment, but the exhaust blower 26*a* may be controlled based on the signal for detected flow velocity from the sensor 15F, while the exhaust blower 26*d* may be controlled based on the signals for detected flow velocity from the sensor 15R individually.

Furthermore, control means for detecting the actuation signal is not necessarily restricted to the PID adjuster 21, and means for variably controlling the exhaust flow rate is not necessarily limited only to the control for the numbers of the rotation of the motors 28*a* and 28*d* also in this embodiment.

What is claimed is:

1. A method of operating an air-supplied type coating booth, in which conditioned air supplied from an air supply blower to a plenum chamber is enforced downwardly to the inside of a tunnel-shaped coating booth and the air thus enforced in the coating booth is drawn to discharge by an exhaust blower together with paint mists, evaporated organic solvents and the likes to the beneath of the floor, wherein the method comprises:

a step of detecting the flow velocity of air streams flowing into and out of the inlet and the exit opened at both ends of the coating booth by flow velocity sensors;

a step of applying primary averaging processing to signals for detected flow velocity by sampling the signals at a relatively shorter sampling period for the variations that are contained therein caused by the characteristics of the sensors or the likes and fluctuate at relatively higher cycles;

a step of applying secondary averaging processing to the signals after the primary averaging processing by sampling the signals at a relatively longer sampling period for the variations that are contained therein caused by the passage of coated objects at the inlet and the exit of the coating booth and the like and fluctuate at relatively lower cycles;

a step of judging the direction of the air flow and determining the flow velocity thereof at the inlet and the exit; and a step of variably controlling the flow rate of the exhaust air discharged from the exhaust blower in accordance with the direction and the flow velocity of the air thereby suppressing the air flowing into or out of the coating booth through the inlet and the exit thereof.

2. A method of operating an air supplied type coating booth as defined in claim 1, wherein the sampling period for the primary averaging processing is less than 2 seconds.

3. A method of operating an air supplied type coating booth as defined in claim 1, wherein the sampling period for the secondary averaging processing is less than 15 seconds.

4. A method of operating an air supplied type coating booth as defined in claim 1, wherein the primary averaging processing is applied by digital filter means working on a transmission function of a first order lag system.

5. A method of operating an air supplied type coating booth as defined in any one of claims 1 to 3, wherein the primary averaging processing is applied by a moving averaging processing having from 2 to 30 seconds of the moving averaging processing time.

6. A method of operating an air supplied type coating booth as defined in any one of claims 1 to 3, wherein the secondary averaging processing is applied by a moving averaging processing having from 10 to 180 seconds of the moving averaging processing time.

7. A method of operating an air supplied type coating booth as defined in claim 4, wherein the secondary averaging processing is applied by a moving averaging processing having from 10 to 180 seconds of the moving processing time.

8. A method of operating an air supplied type coating booth as defined in claim 5, wherein the secondary averaging processing is applied by a moving averaging processing having from 10 to 180 seconds of the moving averaging processing time.

9. A method of operating an air-supplied type coating booth as defined in claim 1, wherein the value obtained by the moving averaging processing is defined as a mean value for the n shots of input signals sampled at a period of T/(n−1) within the averaging time T defined by the following equation:

$$V = \left( \sum_{i=1}^{n} Hi \right) / n$$

where

V: signal obtained by applying moving averaging processing

Hi: sampled input signal.

10. A method of operating an air-supplied type coating booth, in which conditioned air supplied from an air supply blower to a plenum chamber is enforced downwardly to the inside of a tunnel-shaped coating booth and the air thus enforced in the coating booth is drawn to discharge by exhaust blower means together with paint mists, evaporated organic solvents and the likes to the beneath of the floor, wherein a plurality of exhaust blowers are disposed each corresponded to each of divisional zones defined along the longitudinal direction of the coating booth and wherein the method comprises:

a step of detecting the flow velocity and the flow direction of air streams flowing into and out of the inlet and the exit opened at both ends of the coating booth, and a step of determining the direction and the flow velocity of the air streams at the inlet and the exit, and a step of variably controlling the flow rate of exhaust air discharged from exhaust blowers disposed at the inlet and the exit of the coating booth in accordance with the flow direction and the flow velocity of the air streams at the inlet and the exit of the coating booth.

11. A method of operating an air-supplied type coating booth as defined in claim 8, wherein exhaust blowers disposed at the inlet and the exit of the coating booth are variably controlled in accordance with the flow direction and the flow velocity of the air streams at the inlet and the exit of the coating booth.

* * * * *